US009266628B2

(12) United States Patent
Kleiner et al.

(10) Patent No.: US 9,266,628 B2
(45) Date of Patent: Feb. 23, 2016

(54) DEVICE AND METHOD FOR METERING A BULK MATERIAL

(75) Inventors: Andreas Kleiner, Niederhelfenschwil (CH); René Haid, Oberuzwil (CH)

(73) Assignee: Bühler AG, Uzwil (CH)

( * ) Notice: Subject to any disclaimer, the term of this patent is extended or adjusted under 35 U.S.C. 154(b) by 238 days.

(21) Appl. No.: 13/876,993

(22) PCT Filed: Sep. 30, 2011

(86) PCT No.: PCT/EP2011/067151
§ 371 (c)(1), (2), (4) Date: Mar. 29, 2013

(87) PCT Pub. No.: WO2012/042034
PCT Pub. Date: Apr. 5, 2012

(65) Prior Publication Data

US 2013/0186515 A1 Jul. 25, 2013

(30) Foreign Application Priority Data

Oct. 1, 2010 (EP) ..... 10186017

(51) Int. Cl.

| | |
|---|---|
| ***B65B 1/12*** | (2006.01) |
| ***B65B 1/36*** | (2006.01) |
| ***B65B 1/32*** | (2006.01) |
| ***B65B 43/60*** | (2006.01) |
| ***B65B 51/08*** | (2006.01) |
| *B65B 43/46* | (2006.01) |

(52) U.S. Cl.
CPC ... *B65B 1/36* (2013.01); *B65B 1/12* (2013.01); *B65B 1/32* (2013.01); *B65B 43/60* (2013.01); *B65B 51/08* (2013.01); *B65B 43/465* (2013.01)

(58) Field of Classification Search
CPC ..... B65B 1/10; B65B 1/12; B65B 1/24; B65B 1/40; B65B 1/46; B65B 1/48
USPC ..... 141/1, 10, 12, 71, 77, 80, 83, 94, 141/313–314, 316, 374
See application file for complete search history.

(56) References Cited

U.S. PATENT DOCUMENTS 2,758,765 A * 8/1956 Hopkins et al. ..... 141/71
3,498,020 A 3/1970 Eppenberger (Continued)

FOREIGN PATENT DOCUMENTS

DE 3640520 6/1988
DE 8805620 7/1988

(Continued)

*Primary Examiner* — Nicolas A Arnett
(74) *Attorney, Agent, or Firm* — Davis & Bujold PLLC; Michael J. Bujold

(57) ABSTRACT

The device (1) according to the invention for metering and in particular compressing bulk material (2) comprises a conveyor for metering the bulk material. The device (1) further comprises a measuring device for measuring a measuring variable and a receiving device (20) for receiving a container, in particular a bag (22). The conveyor has an outlet (12) for the bulk material (2). The container has a filling opening (23). The receiving device (20) and the outlet (12) can be positioned relative to each other dependent on the measuring variable during the metering of the bulk material (2) into the filling opening (23). In particular, the outlet (12) and the receiving device (20) can be positioned in a manner that can be controlled and/or regulated.

18 Claims, 7 Drawing Sheets

(56) References Cited

U.S. PATENT DOCUMENTS

| | | | | | |
|---|---|---|---|---|---|
| 3,533,454 | A | * | 10/1970 | Tinsley | 141/10 |
| 3,785,410 | A | * | 1/1974 | Carter | 141/10 |
| 4,047,546 | A | * | 9/1977 | Bassendale et al. | 141/1 |
| 4,567,820 | A | * | 2/1986 | Munsell | 100/65 |
| 4,655,128 | A | * | 4/1987 | St. Clair | 100/145 |
| 4,688,371 | A | | 8/1987 | Hecht | |
| 5,042,539 | A | | 8/1991 | McGregor | |
| 5,244,020 | A | * | 9/1993 | Bruno et al. | 141/83 |
| 5,259,425 | A | | 11/1993 | Johnson et al. | |
| 5,327,947 | A | * | 7/1994 | McGregor | 141/71 |
| 5,336,853 | A | * | 8/1994 | Davidson | 177/146 |
| 6,470,921 | B1 | * | 10/2002 | McGregor | 141/12 |
| 2012/0132316 | A1 | * | 5/2012 | Nielsen | 141/10 |
| 2012/0180435 | A1 | * | 7/2012 | Stelluti | 53/469 |

FOREIGN PATENT DOCUMENTS

| | | |
|---|---|---|
| DE | 19734109 | 2/1999 |
| EP | 0539044 | 4/1993 |
| EP | 0930153 | 7/1999 |
| JP | 2006188247 | 7/2006 |
| WO | 2008/025175 | 3/2008 |
| WO | 2010/052325 | 5/2010 |

* cited by examiner

DEVICE AND METHOD FOR METERING A BULK MATERIAL

The present invention relates to an apparatus and to a method for metering bulk material, and in particular to the use of the apparatus for implementing the method for metering bulk material, having the features of the preambles of the independent claims.

BACKGROUND OF THE INVENTION

DE 197 34 109 A1 discloses an apparatus for metering and discharging a quantity of filling material. The apparatus has a plurality of screw conveyors, which are connected to a through-passage chamber in each case by means of a flexible piece of hose. The through-passage chamber is of horizontally movable design, and therefore it can be moved along synchronously with a packaging container over a certain conveying distance. An outlet of the through-passage chamber is thus fixed in position relative to the packaging container over the certain conveying distance.

EP 0 90 153 A2 discloses an apparatus for compressing recyclable waste material. A housing contains a conveying screw which receives the waste material from a supply location, compresses it during a conveying operation and, following the compressing operation, discharges it to a collecting space.

These apparatuses have the disadvantage that, as bulk material is being metered into a container, the amount of dust generated is frequently pronounced, in particular in the case of flour-containing bulk materials, and also the degree of compacting achieved is often insufficient. Generation of dust may be disadvantageous since dust can contaminate the surroundings and, in addition, can adversely affect the functionality of technical equipment in the surroundings.

WO 2010/052325 A1 discloses a bulk-material-bagging apparatus with a shaking device for compacting metered bulk material.

This apparatus, however has the disadvantage that, as an in particular floury bulk material is being metered, a pronounced amount of dust can be generated. Added to this is the fact that the additionally necessary shaking device often renders the metering apparatus slower, since an additional method step is necessary, and also more complex, and therefore costly, to produce.

WO 2008/025175 discloses an apparatus for packaging of bulk materials in an evacuated environment.

This apparatus, however, has the disadvantage that the necessary evacuation renders the apparatus of complex design and, in addition, the method for metering a bulk material is more complicated to implement.

BRIEF SUMMARY OF THE INVENTION

It is therefore an object of the present invention to avoid the disadvantages of the known apparatuses, that is to say in particular to provide an apparatus and a method by way of which less dust is generated as bulk materials are being metered. It is also an object to increase the degree to which the bulk materials are compacted during the metering operation and to simplify the construction of the apparatus.

These objects are achieved by an apparatus and a method having the features of the independent claims.

The apparatus according to the invention for metering, and in particular compressing, bulk material comprises a conveyor for metering the bulk material. The apparatus further comprises a measuring device for measuring a measurement variable, and also comprises an accommodating apparatus for accommodating a container, in particular a bag. The conveyor has an outlet for the bulk material. The accommodating apparatus and the outlet, as bulk material is being metered into an introduction opening of a container, can be positioned relative to one another in dependence on the measurement variable. In particular, the outlet and the accommodating apparatus can be positioned in a controllable and/or regulatable manner. The accommodating apparatus and the outlet can preferably be positioned relative to one another continuously at least over the course of one metering time period.

An accommodating apparatus, within the context of the application, is understood to mean an apparatus which accommodates and/or supports the container. It is possible, for example, for a container to be suspended and/or set in place in such an accommodating device. The accommodating device may comprise, for example, a clamping means for suspending a bag, or it may also be designed as a movable base surface for a bag, wherein the bag is merely placed on the base surface or, in addition, is also fixed, in particular clamped, in the region of the introduction opening.

A bag, within the context of the present application, is intended to mean a container with at least flexible side walls and, in particular, a flexible base. For example, a bag may thus be produced from fabric, for example cotton, plastics material, for example polyester, and paper or any desired combinations thereof, as are known to a person skilled in the art, wherein side walls and base consist of said material. As an alternative, however, it is possible for a bag to have a non -flexible base, for example consisting of plastics material and/or metal, with side walls made of, for example, cotton and/or polyester to form flexible side walls.

The configuration according to the invention has the advantage that the outlet of the conveyor and the accommodating apparatus can be positioned in relation to one another such that the generation of dust in the surroundings is minimized as much as possible during the metering operation and, at the same time, the operation of compacting the metered bulk material can also be improved.

This can he achieved, for example, in that the outlet is positioned closer to a base of the container at the beginning of the metering operation and, during the metering operation, in dependence on the measurement variable measured, the outlet is moved away from the base, i.e. it is positioned at a greater distance therefrom.

However, it is also possible for example at the beginning of the metering operation to set a large distance, in order for the conveyor to achieve the highest possible rate for conveying the bulk material, whereupon the distance from the base of the container is then reduced in order to finish off the compacting operation by the bulk material metered from the conveyor. This method should preferably be used with be materials which do not generate a large amount of dust during the metering operation.

A further advantage of the configuration of the apparatus according to the invention is a simplified construction, since there is no need for either devices for generating a vacuum or shaking apparatuses for compacting purposes. This also has the advantage that, by doing away with the need for compaction by means of a shaking device, the metering operation can take place more quickly since, in particular, there is no additional method step necessary for this purpose.

In particular, the apparatus, as described above and hereinbelow, has input means for setting at least one operating parameter for metering the bulk material. Operating parameters constitute at least one of the following parameters or a combination thereof: type of bulk material; bulk-material volume to be metered; weight to be metered; conveying rate of the conveyor; overall metering duration; positioning of the outlet and accommodating apparatus relative to one another at the beginning of the metering operation.

This has the advantage that the apparatus can be set in optimal fashion for metering purposes, in dependence on the selected operating parameters, and therefore the generation of dust is minimized and the operation of compacting the bulk material is improved.

For example, the positioning of the outlet and accommodating apparatus relative to one another at the beginning of the metering operation is dependent on the bulk material which is to be metered, and therefore the optimum positioning of the outlet and accommodating apparatus relative to one another can be set automatically by the apparatus in dependence on the type of bulk material which has been selected or pre-set.

According to one variant, the operation of metering the bulk material can take place, in particular, as continuous metering of the bulk material. This means that, from a reservoir of bulk material, in each case the required quantity i.e. weight and/or volume, is introduced into the container, wherein in particular the already metered volume and/or weight should be measured in the process.

As an alternative, the bulk material can be metered, in particular, in a batch process, i.e. the quantities of bulk material which are to be metered have already been apportioned in an earlier method step, and therefore there is no need to monitor the already metered quantity of bulk material during the metering operation.

Preferably at least one of the following measurement variables can be measured in order for the accommodating apparatus and outlet to be positioned relative to one another: current consumption of the conveyor; weight of the metered bulk material; filling height of the bulk material in the container; metering time; metered volume of the bulk material.

This has the advantage that, in dependence on the bulk material used, the most advantageous measurement variable can be selected in order for the accommodating apparatus and outlet to be positioned relative to one another.

The current consumption of the conveyor, which is an indicator of the resistance of the bulk material which is to be metered and thus indicates the relative positioning of the accommodating apparatus and outlet in dependence on this measurement variable, can be used as relative-positioning measurement variable, wherein in particular the relative positioning can take place in a regulated manner.

The weight of the metered bulk material can be determined, for example, by a set of scales fitted in and/or on the accommodating apparatus. As an alternative, it is also possible for the weight of the bulk material metered, for example, from a supply container to be determined by means of a set of scales for determining the weight reduction of the supply container or else also using a set of differential-weight scales according to WO 2010/052325 A1.

The filling height can be determined, for example, by means of a filling-level sensor and/or a camera.

The metered volume of bulk material can be determined, for example, via an adjustable rate for conveying bulk material on the conveyor, by means of the measured metering time, and therefore, once the overall metering duration has been achieved, the volume of bulk material which is to be metered is achieved. The metered volume may also be determined for example from the weight of the metered bulk material.

The weight of the metered bulk material, a filling height of the bulk material in the container or also a metering time can be correlated, for example, with previously stored data in data-processing means present, for example, in the apparatus, and therefore it is possible to set optimum positioning between the outlet and accommodating apparatus, wherein the outlet and accommodating apparatus can be positioned, in particular, in a controllable manner.

A combination of the various measurement variables for positioning the accommodating apparatus and outlet is also conceivable in order to improve the compacting operation further and/or to avoid the generation of dust. For this purpose, it is possible, for example, for a first positioning to take place on account of a filling height of the bulk material in the container, or also on account of the metering time, i.e. for a control operation of the positioning to take place, wherein this positioning is then regulated on account of the current consumption of the conveyor.

The accommodating apparatus particularly preferably has a positioning device, ant therefore the accommodating apparatus can be positioned relative to the outlet, and in particular the outlet is fixed in position.

A positioning device, within the context of the present application, is, for example, a combination of guide rails, along which the accommodating apparatus can be moved, and a drive, for example an electric motor, in particular a servomotor, or also a pneumatics unit.

This configuration has the advantage that all that is required is for the accommodating apparatus to be positioned relative to the outlet, this reducing the design outlay and thus rendering the apparatus more cost-effective. This is assisted, in particular, by the fixed-position outlet, i.e. immovable outlet, which simplifies the positioning and thus also increases the positioning precision.

In particular this configuration has the further advantage that, in the case of an outlet being fixed in position in relation to the conveyor, there is no need to move the entire metering apparatus, i.e. the conveyor with drive, since this usually has a high weight. It is thus possible for the positioning device to be simplified and to be operated more favorably in terms of energy.

It is quite particularly preferred for the conveyor to be designed as a screw conveyor, wherein the accommodating apparatus and the outlet can be positioned relative to one another in dependence on a measured torque.

Examples of suitable torque sensors are constituted, indirectly, by the measured current consumption of the screw conveyor for metering purposes, or else also by strain gauges, which are known to a person skilled in the art.

This has the advantage that the measurement can be carried out by means of straightforward and reliable sensors, and therefore regulation of the positioning of the accommodating apparatus relative to the outlet can take place precisely. This is advantageous, in particular, in conjunction with a screw conveyor, of which the rate for conveying bulk material is dependent essentially on the rotational speed of the screw. It is thus possible to use the setting of the rotational speed to set the rate for conveying bulk material, i.e. the volume of bulk material conveyed per unit of time. At a constant rotational speed, the current consumption of the screw conveyor changes in dependence on a conveying resistance of the bulk material. The conveying resistance, also referred to as flow resistance, is dependent, for example, on the filling height of bulk material in the container and on the relative positioning of the outlet of the screw conveyor and of the accommodating apparatus with the container.

In addition, the conveyor is preferably arranged such that the conveying direction of the bulk material in the conveyor is essentially parallel to the action of gravitational force.

The wording which reads a conveying direction is essentially parallel to the action of gravitational force thus means that the conveyor is arranged essentially vertically. Within the context of the present application, essentially parallel to the action of gravitational force means that the conveying direction, and in particular the axis, of a screw of the screw conveyor is at an angle of ±20°, preferably ±10° and particularly preferably ±5°, to the action of gravitational force.

This has the advantage that the conveying action is assisted by gravitational force and thus the amount of energy consumed by the apparatus is reduced. In addition, this design simplifies the apparatus since there is no need for any angled pipes for transporting the bulk material, and therefore the apparatus is further simplified, and thus also more cost-effective.

In addition, it is particularly preferred if the accommodating apparatus can be positioned in the conveying direction relative to the outlet. In other words, the accommodating apparatus can be positioned merely essentially parallel to the action of gravitational force.

This has the advantage that the positioning device can be simplified, since merely positioning in one direction is necessary. This renders the apparatus more cost-effective and also simplifies the positioning of the accommodating apparatus in relation to the outlet.

In addition, it is particularly preferred if the accommodating apparatus is designed such that the outlet can engage in the container during the metering operation.

This has the advantage that the outlet can also be placed, inter alia, adjacent to the base of the container in order to avoid the generation of dust, which is often very pronounced particularly at the start, and thus most of the dust generated remains in the container.

As an alternative, the accommodating apparatus preferably has a fastening device for fastening the introduction opening.

This fastening device is configured such that the introduction opening of the container is formed such that the outlet can engage in the container and, in addition, air which is displaced by the metered bulk material can escape from the container.

As an alternative, the accommodating apparatus particularly preferably has a supporting device for supporting a base of the container. This supporting device is designed, in particular, as a bearing surface.

This has the advantage that the base of the container is supported on the outside of the base, and this therefore reduces the risk of the container being damaged by the metered bulk material. This is important, in particular, if use is made of bags which could tear if metering takes place quickly.

The apparatus preferably has a compacting device which is arranged, during operation, between the base and introduction opening and is intended for compacting the bulk material during the metering operation, wherein the compacting device is fixed relative to the outlet. In particular, the compacting device is arranged between the base and fastening device.

A compacting device, within the context of the present application, is understood to mean a device by means of which, at least as the bulk material is being metered into the container, the operation of compacting the metered bulk material is improved. This can take place, for example, by means of the container being constricted between the base and fastening device and/or by means of a plate arranged between the base and fastening device, wherein the plate has essentially a cross section complementary to the introduction opening and can engage in the container; if use is made of a non-constrictable container, it is advantageous for just a plate to be used.

The arrangement of a compacting device has the advantage that this improves the compacting operation during the metering operation and thus ensures the control and/or regulation of the position of the outlet in dependence on the measurement variable, for example the torque and/or the current consumption of the conveyor. In some circumstances, it is possible, without the arrangement of the compacting device, for bulk material to rise up, along the conveyor, to the introduction opening of the container, as a result of which it is very difficult for the bulk material to be compacted, and therefore control and/or regulation of the position of the conveyor is unreliable.

This configuration of the apparatus by means of the arrangement of a compacting device has the further advantage that bulk material which is conveyed into the container, through the outlet, by means of the conveyor is prevented, at least in part, by the compacting device from being conveyed in the direction of the introduction opening by the metering operation, for example by pressure fluctuations occurring thereby in the container. As a result of the metering operation, it is indeed the case that bulk material, at least in part, is swirled up again and can thus settle on the outside of the conveyor, which does project into the container. Current understanding shows that this is reduced by the arrangement of the compacting device. Such depositing of bulk material on the outside has the disadvantage that, for example, a cleaning step is necessary and there is an increase in the probability of contamination during a following metering procedure, for example during the operation of metering another bulk material.

The compacting device is particularly preferably designed as a constricting device for constricting a bag accommodated in the accommodating apparatus. The constricting device comprises an opening for accommodating the bag, wherein during operation, when used as intended, the outlet can be positioned between the base of the bag and the opening.

A constricting device, within the context of the present application, is understood to mean an apparatus by means of which the side well of a bag can be deformed in order to reduce the cross section of the bag at least in the region of the constricting device. This can be achieved, for example, by means of a clamping device defining an opening, in which the bag is accommodated, if the circumference of the opening is smaller than the circumference of the side wall of the bag, as a result of which the bag is constricted in the region of the constricting device. This can take place, for example, by clamping levers or wire ties or other suitable means.

Constricting a bag, which is accommodated in the constricting device, between the base and introduction opening of the bag, within the context of the present application, means that, when used as intended in the apparatus, constriction takes place between the introduction opening of the bag and the base of the bag. In particular, this constriction takes place in a plane essentially perpendicular to the action of gravitational force, i.e. essentially parallel to the introduction opening of the bag.

A fixed arrangement of the constricting device relative to the outlet of the conveyor, within the context of the present application, means that, in the case of the outlet being fixed in position, the constricting device is likewise fixed in position and, in the case of variable positioning capability of the outlet, the constricting device is positioned essentially parallel to the outlet.

For example, it is thus the case that the bag is fastened on the introduction opening by means of the fastening device, wherein the constricting device constricts the bag between the base of the bag and the fastening device; the opening formed by the constricting device is oriented essentially parallel to the introduction opening; during operation, when used as intended, the outlet can thus be positioned such that it can engage in the introduction opening of the bag and the opening of the constricting device.

It is quite particularly preferred for the opening to be essentially complementary in shape to the cross section of the outlet, such that the outlet can engage in the opening and a bag can be constricted between the constricting device and outlet.

As an alternative, it is quite particularly preferred for the apparatus to be designed as a bagging carousel.

Bagging carousel, within the context of the present application, is understood to mean an apparatus for metering bulk material into a container which has at least one accommodating apparatus for accommodating a container, wherein the bagging carousel has a fastening position for fastening the introduction opening on the fastening device. In addition, the bagging carousel has a metering position, for metering bulk material into the container, and a removal position, at which the container is removed from the bagging carousel. The bagging carousel also has means for transporting the container from the fastening position to the metering position and to the removal position.

This has the advantage that steps of a complete metering process can take place at different positions, and therefore it is possible to accelerate fastening, metering and removal of the container.

The apparatus preferably has a fitting device for fastening a container in an automated manner on the fastening device.

This can take place, in particular, in that, for example if the containers used are bags, the latter can be stacked in an empty state, i.e. without any bulk material, at the fastening position and the machine grips a bag as required by means of a gripping device, in particular a robot, and fastens it on the fastening device. As an alternative, it is also possible, for example, for containers with fixed walls to be conveyed, by means of a transporting belt, to the fastening position and to be fastened, in particular gripped, there by means of a mechanism which is known to a person skilled in the art.

The apparatus particularly preferably has a removal device for removing the container in an automated manner from the fastening device.

These two preferred embodiments have the advantage that the operation of metering bulk material into a container can be accelerated further and thus the costs can be lowered further.

A further aspect of the present invention is directed to a method for metering, and in particular compressing, bulk material. This method is implemented, in particular, by an apparatus described above. This method comprises the step of positioning a conveyor and an accommodating apparatus relative to one another with a distance between an outlet of the conveyor and a base of a container, in particular of a bag, in the accommodating apparatus. It is possible here for the operations of positioning the conveyor and of fastening the container in the accommodating apparatus to take place in any desired order. This is followed by an operation of metering the bulk material, by means of the conveyor, into the container through an introduction opening of the container. A measurement variable is measured at least during the metering operation, wherein, in particular, current consumption of the conveyor, a weight of the metered bulk material, a filling height of the bulk material in the container, a metered volume of the bulk material or a metering time is measured. It is also possible for the aforementioned measurement variables to be measured successively or simultaneously. This is followed by the operation of adjusting the distance between the outlet and base in dependence on at least one of the measurement variables measured during the metering operation.

This method is implemented, in particular, by an apparatus like that described above, and therefore has all the advantages of the apparatus described above.

A distance between the outlet and base, within the context of the application, is defined as a distance parallel to gravitational force between the lowermost point of the base in the region of a projection of the outlet onto the base taken parallel to gravitational force and the average between the lowermost and highest point of the outlet, when used as intended, with account being taken exclusively of the distance in the direction of gravitational force. In other words, a distance perpendicular to the direction of gravitational force is not taken into account.

The conveyor preferably used in the method is a screw conveyor wherein the accommodating apparatus and the outlet are positioned relative to one another in dependence on a measured torque. In particular, the accommodating apparatus is positioned relative to the outlet.

This configuration of the method also has the above-described advantages relating to torque measurement and the positioning of the accommodating apparatus relative to the outlet.

The outlet is particularly advantageously fixed in position. The distance is particularly preferably increased during the metering operation. In particular, the distance is controlled and/or regulated in dependence on the measurement variable measured.

This configuration of the method also has the above-described advantages relating to the apparatus.

A particularly preferred distance is one of less than 10 cm, preferably less than 8 cm, particularly preferably less than 5 cm and quite particularly preferably of less than 1 cm.

It is quite particularly preferred for the distance to be adjusted continuously at least over the course of one metering time period.

This has the advantage that the distance is not just controlled and/or regulated at certain points, and therefore the positioning in dependence on the measurement variable can take place more precisely, and thus generation of dust is reduced and the degree of compaction is increased.

The outlet preferably engages in the container throughout the duration of the metering operation.

During the metering operation a compacting device for compacting the metered bulk material is preferably fixed on and/or in the container in relation to the outlet. In particular, the compacting device is a constricting device, wherein the bag is constricted by means of the constricting device between the base and introduction opening.

The distance is particularly preferably adjusted during the metering operation such that the outlet is positioned between the base and a constricting device for at least 50% of the metering time. The outlet is preferably positioned between the base and the constricting device for at least 70%, particularly preferably for at least 90% and quite particularly preferably for 100%, of the metering time.

This has the advantage of better compaction of the bulk material in the container and of less bulk material being deposited on the outside of the conveyor.

A further alternative aspect of the present invention is directed to the use of an apparatus as described above for implementing a method as described above for metering bulk material. In particular, the bulk materials metered are those from the list of the following products or mixtures thereof: cement, lime, plastics material, grain, semolina, flour, bran, animal feed, sugar and salt.

This use takes place with an apparatus as described above, by way of the method described above, and therefore has all the corresponding advantages.

An additional alternative aspect is directed to an apparatus having a screw conveyor for metering bulk material. In particular, the apparatus corresponds to the apparatus described above. In addition, the screw conveyor is used to compress in particular bulk material. The screw conveyor, when used as intended, is arranged essentially vertically.

The wording essentially vertically, within the context of the present application, means that the axis of the screw of the screw conveyor, when used as intended, is oriented essentially parallel to gravitational force, in particular in an angle range of ±20°, preferably of ±10° and quite particularly preferably ±5°, in relation to the direction of action of gravitational force.

This configuration of the apparatus has the advantage that the apparatus for metering bulk material is simplified, since there is no need in particular for any angled pipes for conveying the bulk material in a container and, in addition, the operation of conveying the bulk material into the container is assisted by gravitational force and, as a result, the amount of energy used up is reduced. In addition, the design of the apparatus reduces the risk of the product remaining on the apparatus over a relatively long period of time as a result of not being conveyed reliably. This may be the case, for example, if, in particular in the region of bends of pipes through which the bulk material is conveyed, bulk material accumulates and is not transported any further, which is undesirable.

BRIEF DESCRIPTION OF THE DRAWINGS

The invention will be explained in more detail hereinbelow with reference to exemplary embodiments to give a better understanding, although the invention is not limited to these exemplary embodiments. In the figures.

DETAILED DESCRIPTION OF THE DRAWINGS

Figure 1:
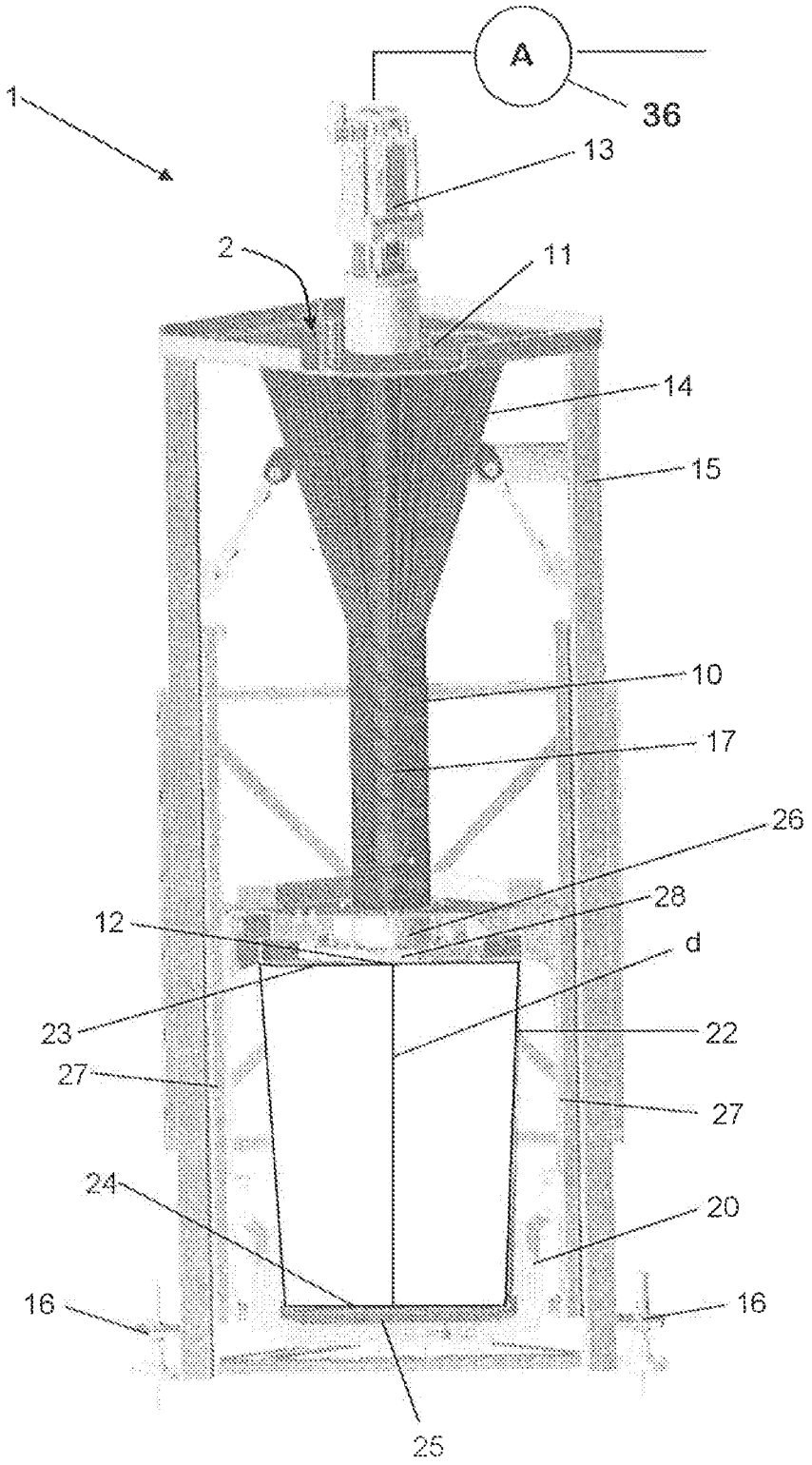
FIG. 1 shows a schematic illustration of an apparatus according to the invention in a first position.

FIG. 1 shows a schematic illustration of an apparatus 1 according to the invention for metering hulk material 2. The apparatus 1 has a framework 15, in which are fitted a screw conveyor 10, a fastening device 26, an accommodating apparatus 20 and a positioning device 27.

A screw 17 of the screw conveyor 10 is driven, i.e. made to rotate, by means of a drive 13. The screw conveyor 10 has a hopper-like inlet region 14 with an inlet 11. The screw conveyor 10 also has an outlet 12, which engages in the fastening device 26.

The accommodating apparatus 20 accommodates a bag 22, specifically an introduction opening 23 of the bag 22. The fastening device 26 is part of the accommodating apparatus 20. A base 24 of the bag 22 is supported by a bearing surface 25 of the accommodating apparatus 20. The base 24 is spaced apart from the outlet 12 of the screw conveyor 10 by a distance d=75 cm.

The positioning device 27 can position the accommodating apparatus 20 in the vertical direction, i.e. parallel to the axis of the screw 17, relative to the screw conveyor 10.

The apparatus 1 also has two set-down means 16 for orienting, and in particular for adjusting the angle of, the apparatus in relation to the action of gravitational force.

During operation, bulk material 2 is conveyed, in the direction of the arrow designated by 2, into the inlet 11 and is metered into the bag 22 by means of the screw conveyor 10, wherein a torque of the screw conveyor is measured using a measuring device (not shown) and the distance a between the outlet 12 and base 24 is adjusted by means of the positioning device 27 in dependence on the measured torque.

Figure 2:
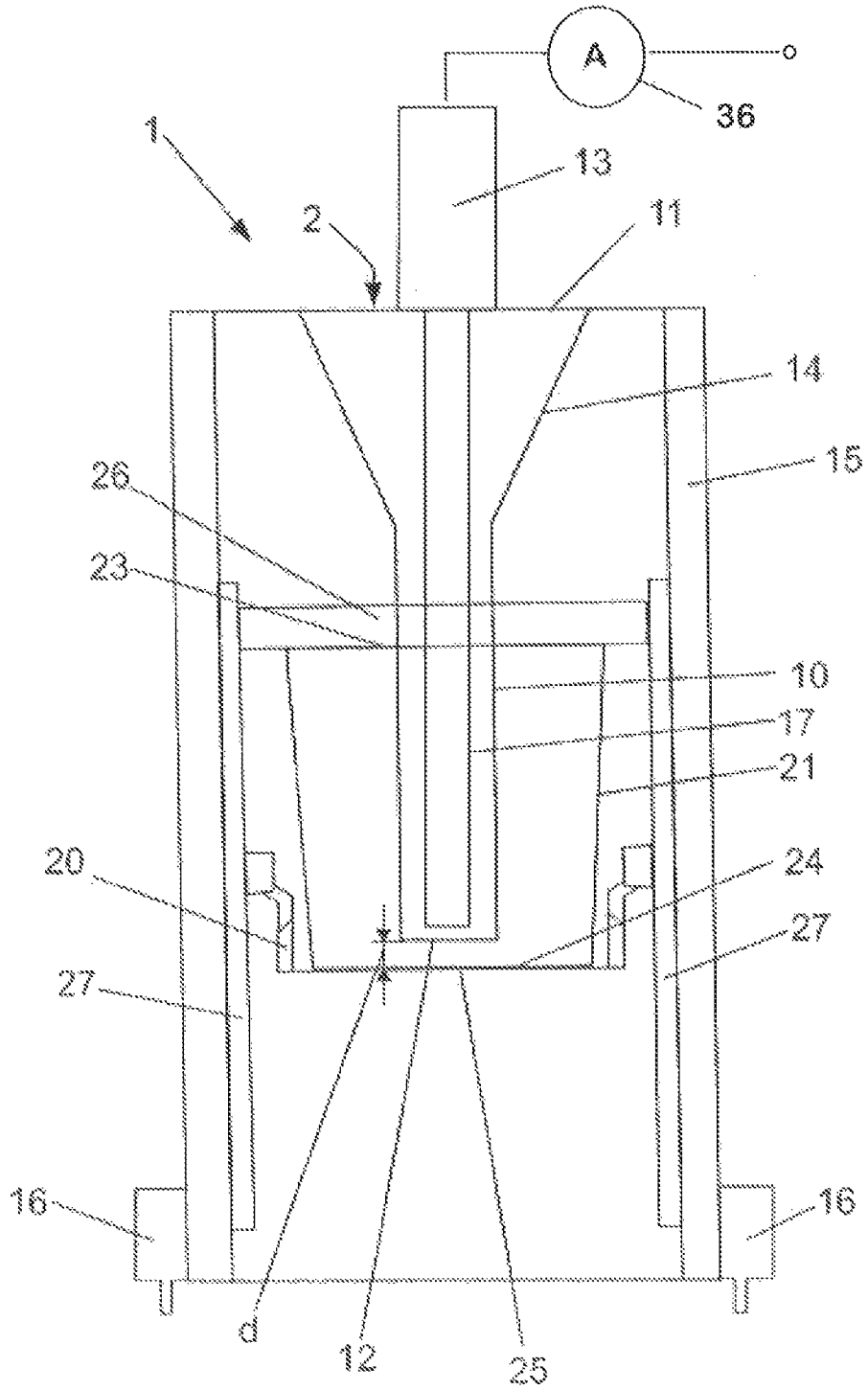
FIG. 2 shows a schematic illustration of an apparatus according to the invention in a second position.

FIG. 2 shows the apparatus according to FIG. 1. of the invention in a second position. The same reference signs designate the same features as described in FIG. 1 and will be explained anew only as required.

A screw conveyor 10 with a screw 17 engages in a container 21 with an introduction opening 23 in a fastening device 26. The container 21 has a base 24, wherein an outlet 12 of the screw conveyor 10 is positioned adjacent to the base 24 of the container 21, i.e. the distance d is approximately 5 cm.

During operation, then, bulk material 2 is conveyed through the inlet 11 of the screw conveyor 10 and is metered into the container 21 by means of the screw conveyor 10. During the metering operation, a torque is determined, by means of a measuring device 36, via the current consumption of the screw conveyor, and therefore, in the case of the current consumption increasing, an accommodating apparatus 20 is moved away parallel to the axis of the screw 17, i.e. parallel to the action of gravitational force, as a result of which the distance d is increased.

Figure 3:
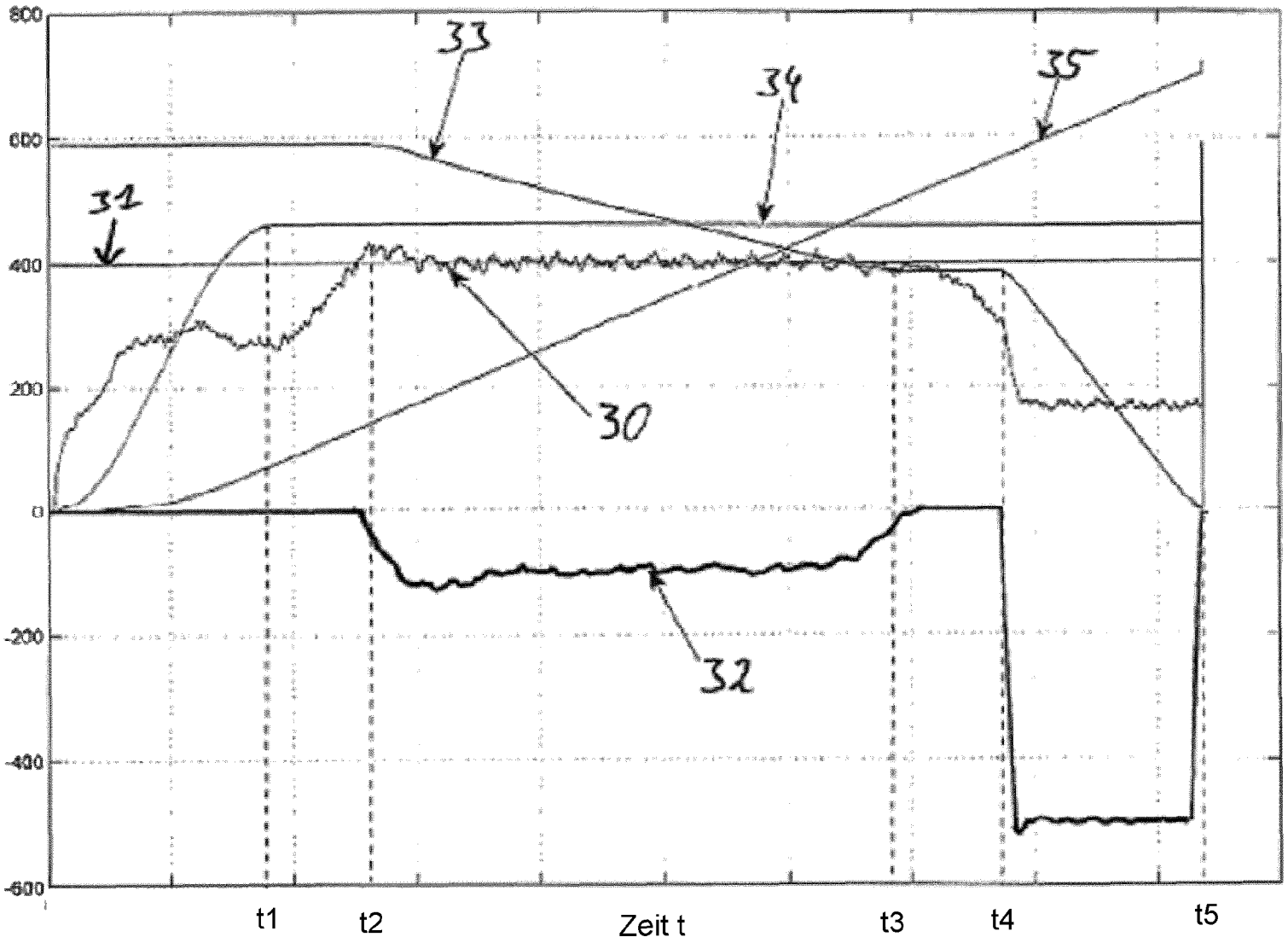
FIG. 3 shows a diagram of a procedure for metering semolina plotted against time.

FIG. 3 illustrates a procedure for metering bulk material, for example semolina, into a bag using an apparatus according to the invention.

At the point in time $t_0$, position 33 of an accommodating apparatus is selected such that a distance between a base of the bag and an outlet of a screw conveyor is <5 cm.

At the point in time $t_0$, the metering procedure is begun, wherein the metered volume i.e. the accumulated filling volume, is represented by the curve 35. At the same time, the operation of measuring the torque is begun, this being represented by the curve 30, and is compared with desired torque 31. A rotational speed 34 of a conveying screw is set to a constant value following a start-up time of $t_1$.

As soon as a certain quantity of bulk material has been metered into the bag, the torque 30 increases beyond the pre-set desired torque 31, whereupon a distance between an outlet of the screw conveyor and the base of the bag is increased. For this purpose, the accommodating apparatus is accelerated to a speed 32 and is thus moved way from the screw conveyor, as is represented in the region from $t_2$ to $t_3$ by means of the curves relating to the speed 32 and the position 33 of the accommodating apparatus.

As soon as a predefined filling volume according to the curve 35 is reached at approximately $t_4$=seconds, the regulating operation is terminated and the container is positioned such that it can be removed from the apparatus as from the point in time $t_5$.

Figure 4:
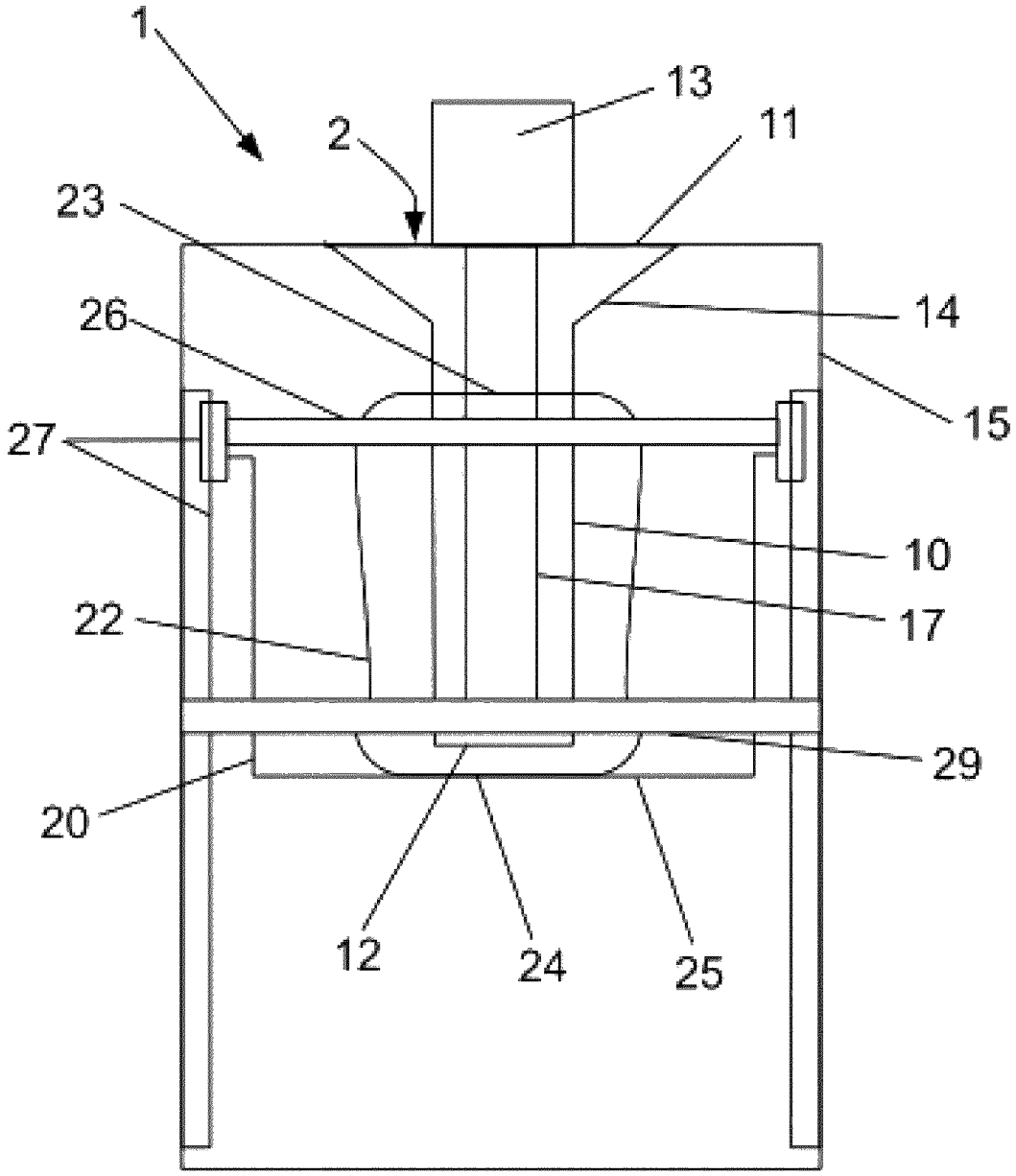
FIG. 4 shows a schematic illustration of an apparatus according to the invention with a constricting device in a starting position.

FIG. 4 illustrates an apparatus according to the invention, like that in FIG. 1, in a starting position. In contrast to FIG. 1, the present apparatus 1 has a compacting device, comprising a constructing device 29, by means of which the bag 22 is constricted in cross section.

The outlet 12 of the screw conveyor 10, comprising a screw 17 is arranged between the base 24 of the bag 22 and the constricting device 29. The constricting device 29, which comprises a clamping lever, is arranged between the fastening device 26 and the base 24.

Figure 5:
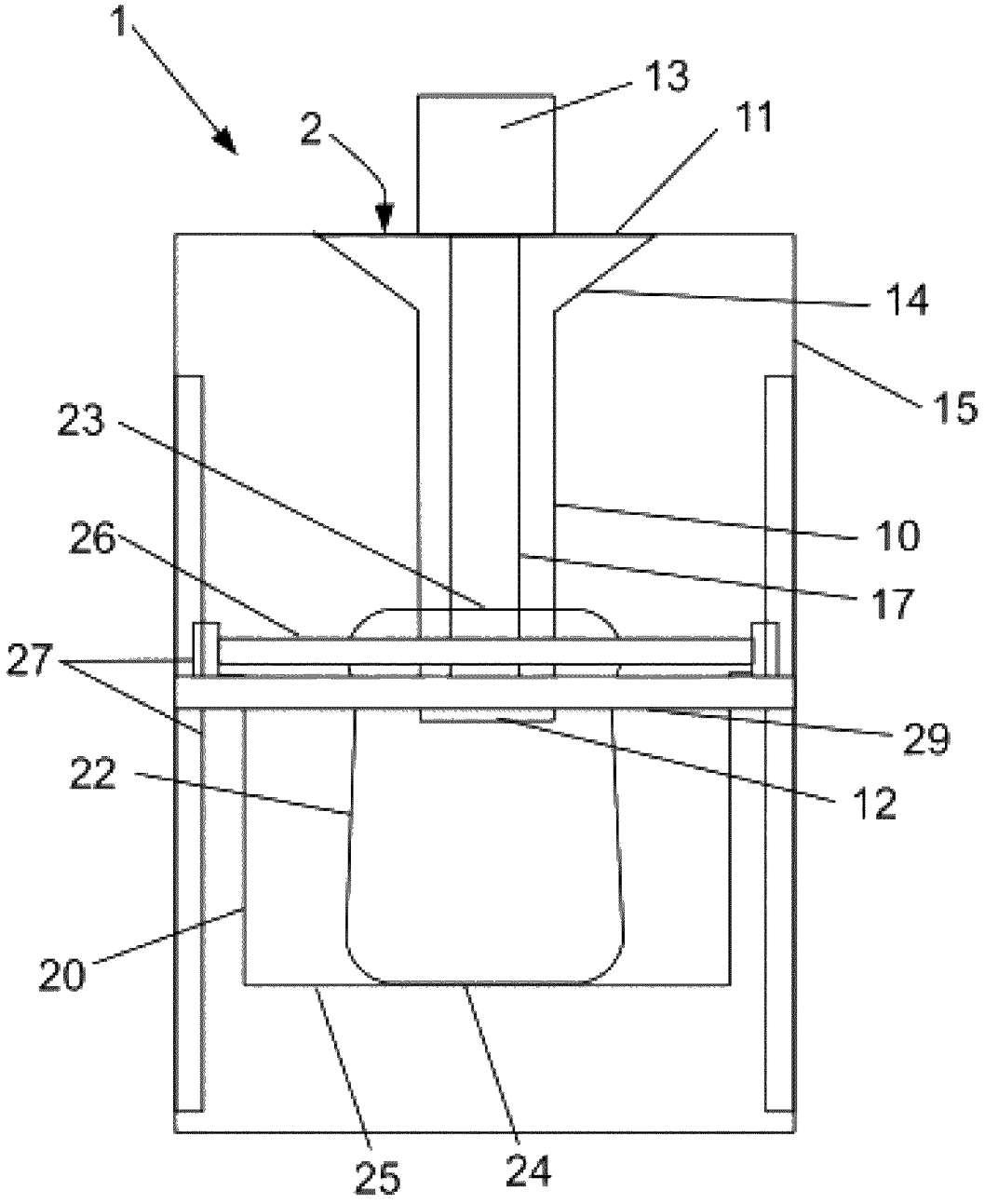
FIG. 5 shows a schematic illustration of the apparatus according to FIG. 4 of the invention in an end position.

During operation, bulk material 2 is conveyed through the inlet 11, by means of the screw conveyor 10, and into the bag 22 through the outlet 12, the bag being constricted in the region of the constricting device 29. As soon as a desired torque is reached, as has been explained in relation to FIG. 3, the bag 22 is positioned by means of the positioning device 27, wherein the base 24 is moved away from the outlet 12 to a position which is illustrated in FIG. 5. The constricting device 29 and the outlet 12 are fixed in position in relation to one another.

FIG. 5 illustrates the end position of the bag 22 at the end of the metering procedure, before said bag is removed from the apparatus 1. Also in FIG. 5, the bag 22 is constricted by means of the constricting device 29. The outlet 12 is located between the base 24 and the constricting device 29 for 100% of the metering time.

Figure 6:
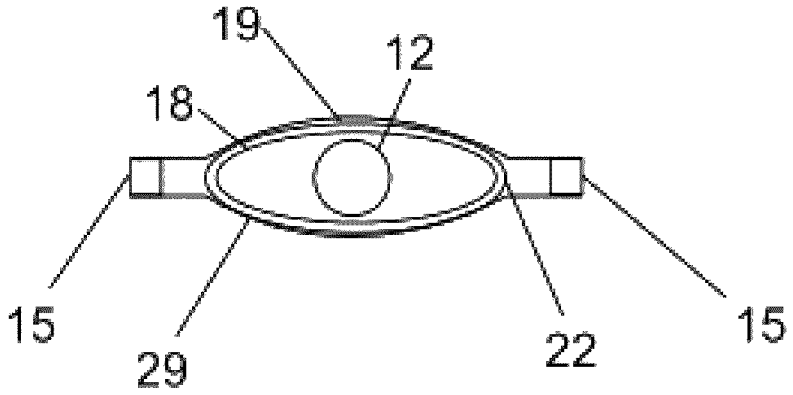
FIG. 6 shows a schematic illustration of a constricting device in a closed position.

FIG. 6 illustrates a schematic plan view of the compacting device, comprising the constricting device 29 according to FIG. 4 and a plate 18, with a bag 22 accommodated therein. The constricting device 29 is fastened on the framework 15 and thus fixed in relation to the outlet 12. The constricting device 29 forms an opening 19, in which the bag 22 is accommodated, as a result of which said bag is constricted. The outlet 12 engages in the opening 19, and thus in the bag 22. The plate 18 is fixed at the outlet 12, and likewise engages in the bag. The plate has a cross section essentially complementary to the introduction opening of the bag 22, and therefore it is made possible for the plate 18 to engage in the bag and the compacting operation is improved.

Figure 7:
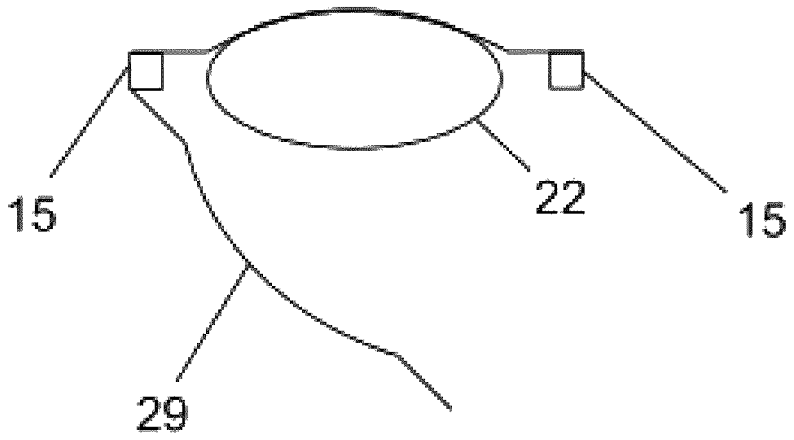
FIG. 7 shows a schematic illustration of the constricting device according to FIG. 6 in an open position.

FIG. 7 shows a schematic plan view of the constricting device 29 according to FIG. 6. The constricting device 29 according to FIG. 7 is located in an open position, and therefore a bag 22 can be fastened in the apparatus, the constricting device 29 then being closed in order to constrict the bag 22 in the opening. The outlet is not illustrated here.

Figure 8:
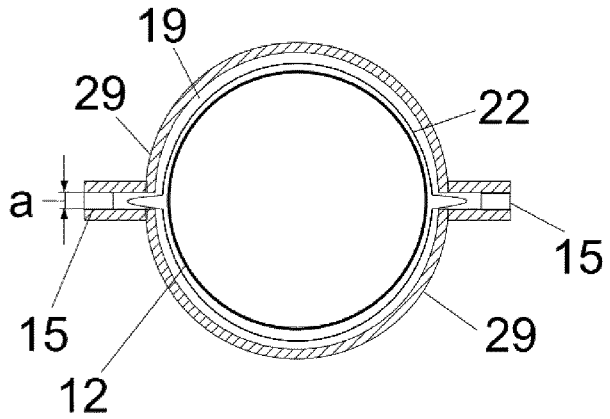
FIG. 8 shows a schematic illustration of an alternative constricting device in a closed position.

FIG. 8 illustrates, schematically, a plan view of a compacting device designed as a constricting device 29. The constricting device 29 has an opening 19 essentially complementary to the cross section of the outlet 12, and therefore the outlet 12 engages in the opening and, in the closed position shown here, a bag 22 is constricted between the constricting device 29 and the outlet 12. It is therefore the case that the bag, in the region of the constricting device 29, has an essentially circular cross section complementary to the cross section of the outlet 12.

The distance a between the two elements designated by 29 is approximately 5 mm. This configuration of the constricting device 29 achieves good compaction during operation.

Figure 9:
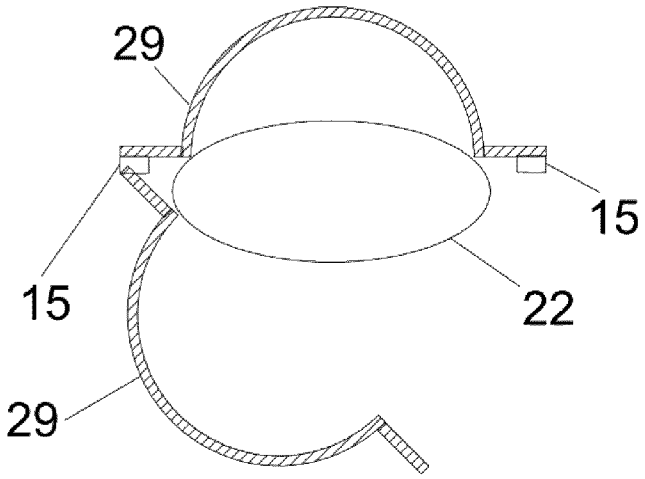
FIG. 9 shows a schematic illustration of the alternative constricting device according to FIG. 8 in an open position.

FIG. 9 illustrates, schematically, a plan view of the constricting device 29 in an open position, without any outlet. Prior to being constricted, the bag 22 has an essentially elliptical cross section.

The invention claimed is:

1. A method for metering and compressing bulk material, comprising the following steps:

positioning a conveyor and an accommodating apparatus relative to one another with a distance (d) between an outlet of the conveyor and a base of a container in the accommodating apparatus; and either continuous metering of the bulk material or batchwise metering of pre-apportioned quantities of the bulk material, by means of the conveyor, into the container through an introduction opening of the container;

wherein a degree to which the bulk material is compacted during metering is increased by:

measuring at least one of the following measurement variables: current consumption of the conveyor; torque on the conveyor; filling height of the bulk material in the container; metering time and adjusting the distance (d) between the outlet and the base either in dependence on the measured variable or in dependence on a combination of the measured variable with a measured weight of the metered bulk material and/or with a measured metered volume of the bulk material.

2. The method as claimed in claims 1, wherein the distance (d) is adjusted continuously at least over the course of one metering time period.

3. The method as claimed in claim 1, wherein, during the metering operation, a compacting device for compacting the metered bulk material is fixed on and/or in the container in relation to the outlet.

4. The method as claimed in claim 1, wherein the distance (d) is adjusted during the metering operation such that the outlet is positioned between the base and a constricting device for at least 50% of the metering time, wherein the container is constricted by the constricting device between the base and the introduction opening.

5. The method as claimed in claim 1, wherein the bulk material is selected from the group consisting of cement, lime, plastics materials, grain, semolina, flour, bran, animal feed, sugar, salt, and mixtures thereof.

6. An apparatus for carrying out a method as claimed in claim 1 for metering and compressing bulk material, comprising:

the conveyor for the bulk material, a measuring device for measuring the at least one measurement variable, and the accommodating apparatus for accommodating the container, wherein the conveyor has an outlet for the bulk material, and wherein the accommodating apparatus and the outlet, as bulk material is being metered into an introduction opening of the container, can be positioned relative to one another either in dependence on the measurement variable or in dependence on a combination of the measured variable with a measured weight of the metered bulk material and/or with a measured metered volume of the bulk material.

7. The apparatus as claimed in claim 6, wherein the accommodating apparatus can be positioned relative to the outlet by means of a positioning device.

8. The apparatus as claimed in claim 6, wherein the conveyor is designed as a screw conveyor, and wherein the accommodating apparatus and the outlet can be positioned relative to one another in dependence on at least the measured torque.

9. The apparatus as claimed in claim 8, wherein the screw conveyor, when used as intended, is arranged essentially vertically.

10. The apparatus as claimed in claim 6, wherein the conveyor is arranged such that the conveying direction of the bulk material in the conveyor is essentially parallel to the action of gravitational force.

11. The apparatus as claimed in claim 10, wherein the accommodating apparatus can be positioned in the conveying direction relative to the outlet.

12. The apparatus as claimed in claim 6, wherein the accommodating apparatus is designed such that the outlet can engage in the container during the metering operation.

13. The apparatus as claimed in claims 6, wherein the accommodating apparatus has a fastening device for fastening the introduction opening.

14. The apparatus as claimed in claim 13, wherein the apparatus has a fitting device for fastening a container in an automated manner on the fastening device.

15. The apparatus as claimed in claim 13, wherein the apparatus has a removal device for removing a container in an automated manner from the fastening device.

16. The apparatus as claimed in claim 6, wherein the accommodating apparatus has a supporting device for supporting a base of the container.

17. The apparatus as claimed in claim 6, wherein the apparatus has a compacting device which is arranged, during operation, between the base and introduction opening, and wherein the compacting device is intended for compacting the bulk material during the metering operation, wherein the compacting device is fixed relative to the outlet.

18. The apparatus as claimed in claim 17, wherein the compacting device is designed as a constricting device for constricting a bag accommodated in the accommodating apparatus, the device comprising an opening for accommodating the bag, wherein during operation, when used as intended, the outlet can be positioned between the base of the bag and the opening.

* * * * *